US006200422B1

(12) United States Patent
Shakespeare et al.

(10) Patent No.: US 6,200,422 B1
(45) Date of Patent: Mar. 13, 2001

(54) METHOD AND APPARATUS FOR CONTROLLING A MOVING PAPER WEB

(75) Inventors: John Shakespeare, Siuro; Juha Kniivilä, Tampere, both of (FI)

(73) Assignee: Neles Paper Automation Oy, Tampere (FI)

( * ) Notice: Subject to any disclaimer, the term of this patent is extended or adjusted under 35 U.S.C. 154(b) by 0 days.

(21) Appl. No.: 09/339,415

(22) Filed: Jun. 24, 1999

(51) Int. Cl.[7] ..... D21F 7/00; D21F 11/00

(52) U.S. Cl. ..... 162/198; 362/263; 362/266; 362/DIG. 6; 362/DIG. 10; 362/DIG. 11; 73/37.6; 73/159; 700/128; 700/129

(58) Field of Search ..... 162/198, 263, 162/265, 266, DIG. 10, DIG. 11, DIG. 6; 73/862.45, 862.47–862.48, 37.5–37.9; 700/127–129

(56) References Cited

U.S. PATENT DOCUMENTS

| | | | | |
|---|---|---|---|---|
| 4,680,089 | * | 7/1987 | Aral et al. | 162/198 |
| 5,052,233 | | 10/1991 | Rantala . | |
| 5,093,795 | * | 3/1992 | Lewis | 364/471.03 |
| 5,104,488 | * | 4/1992 | Chase | 162/198 |
| 5,262,955 | * | 11/1993 | Lewis | 364/471.06 |
| 5,649,448 | | 7/1997 | Koskimies et al. . | |
| 5,658,432 | * | 8/1997 | Heaven et al. | 162/198 |
| 5,715,158 | * | 2/1998 | Chen | 364/150 |
| 5,898,589 | * | 4/1999 | Shakespeare et al. | 364/471.03 |

OTHER PUBLICATIONS

Michael Odell, "Optimize or comprise: The art of former section tuning", 51st Appita Annual General Conference, 1997 Proceedings, vol. 1, pp. 3096–316.

K R Wadhams, S J I'Anson, D M James and H W Kropholler, "The measurement of differential CD shrinkage", Paper Technology Journal 1991, pp. 3638.

C Enea Di Mauro, R Keith Wadhams, E Peter Wellstead, "New On–Line Sensor For Paper Shrinkage Measurement", Paper Science Dept., Control Systems Centre, pp. 145151.

* cited by examiner

*Primary Examiner*—Stanley S. Silverman
*Assistant Examiner*—José A. Fortuna
(74) *Attorney, Agent, or Firm*—Alston & Bird LLP

(57) ABSTRACT

Method and apparatus for controlling moving paper web during manufacture or subsequent processing, wherein a web elongation profile and a moisture profile are measured. The web elongation is governed by at least two CD moisture actuators, which are situated at different stages in the web manufacturing process or subsequent processing. Means for measuring the web elongation profile and the moisture profile are situated after the CD actuators.

22 Claims, 3 Drawing Sheets

METHOD AND APPARATUS FOR CONTROLLING A MOVING PAPER WEB

FIELD OF THE INVENTION

The invention relates to a method of controlling a moving paper web during manufacture or subsequent processing. The invention further relates to an apparatus for controlling a moving paper web during manufacture or subsequent processing.

BACKGROUND OF THE INVENTION

The paper web deforms geometrically during manufacture, or during subsequent processing operations, especially operations involving wetting or drying of the paper web. This deformation includes shrinking as its water content falls below about 35% by mass, and stretching or elongation due to applied forces. Forces are applied especially in the direction of movement of the web, including a tension in the plane of the web. The tension is generally not uniform, since the shrinkage and elongation are not uniform, and these three properties are related to each other. However, shrinkage and elongation are properties of the paper web, while tension is a property of the process. Nonuniformity in the web tension leads to problems in operating the paper making or paper processing equipment, including web breaks which cause production interruptions. Nonuniformity in the elongation leads to a variety of problems, including sheet breaks, caused by the fact that the paper web is longer in some place than in others.

U.S. Pat. No. 5,694,448 discloses a solution for regulating the web tension profile. That method requires measurement of the caliper and grammage profiles in addition to the web tension profile. Further, it achieves its aim of controlling the web tension profile by manipulating the actuators which are also used to control the profiles of caliper and grammage. Thus, improvements in the web tension profile are generally achieved at the cost of effects in the caliper and grammage profiles, and a compromise solution is obtained. Further more, the solution enables the regulation of the web tension profile only, and does not consider the web elongation profile.

An article "Optimize or compromise? The art of former section tuning". Odell M. 51 Appita Annual General Conference 1997 Proceedings, Volume 1 discloses controlling the web tension profile by using a steam box in the press section to adjust the shape of the moisture profile going into the dryers. By making the edges drier and thus changing the drying rate profile it is possible to reduce the tension profile error at the reel. The moisture profile at the reel is corrected using rewetting in the dryers. In this case too, only the web tension is adjusted, and does not consider the web elongation profile. In failing to consider the web elongation, control of the web tension can lead to an inferior solution with undesirable effects on the web elongation profile.

SUMMARY OF THE INVENTION

It is an object of the invention to provide a method and an apparatus, in which the above drawbacks can be avoided.

The method of the invention is characterized by comprising the steps of measuring a web elongation profile and a moisture profile and controlling the web elongation by at least two actuators which affect the cross machine direction (CD) moisture profile, said actuators being situated at different stages in the web manufacturing process, and means for measuring the web elongation profile and the moisture profile being situated after the CD moisture actuators.

Further, the apparatus of the invention is characterized by comprising means for measuring a web elongation profile and a moisture profile, at least two actuators, which affect the CD moisture profile and means for controlling the web elongation by said CD moisture actuators, said CD moisture actuators being situated at different stages in the web manufacturing process, and the means for measuring the web elongation profile and the moisture profile being situated after the CD moisture actuators.

The basic idea of the invention is that the web elongation is controlled by use of at least two actuators which affect the CD moisture profile, said actuators being situated at different stages in the web manufacturing process. Preferably, a first CD moisture actuator is situated in the wet press or elsewhere near the wet end of the paper machine, and a second CD moisture actuator is situated near the reel or elsewhere near the dry end of the paper machine. A first moisture profile measurement device and a first web elongation profile measurement device are situated after the second moisture profile actuator. The moisture and web elongation profile measurements need not be at exactly the same location, but preferably there are no wetting or drying processes between them.

The elongation profile can be measured directly for example by using a method disclosed by K. R. Wadhams et alii, "The measurement of differential CD shrinkage", Paper Technology, January 1991. Alternatively, the elongation can be inferred tram a known tension profile and a known shrinkage profile. The tension profile can be measured for example by using the method and equipment presented in U.S. Pat. No. 5,052,233. The shrinkage profile can be measured for example by using the method disclosed by E. DiMauro et alii, "New on-line sensor for paper shrinkage measurement", Proc Control Systems '94 (May 31–June 2, Stockholm, Sweden).

Measurements of shrinkage or elongation may be provided from laboratory analysis of samples taken from the paper, or may be provided using on-line measurements. Since tension is a property of the process, it must be provided from on-line measurements Cellulose fibers swell when wetted, and shrink when water is removed. This dimensional change is less along the axis of the fiber than across the axis. Paper is formed from an aqueous suspension in the wet end and dewatered through pressing and drying to a moisture level of typically 5–7%. As a result, it shrinks by several percent. No shrinkage occurs in the initial dewatering in the forming section and presses, as the water content is too high and fiber bonding is weak. As soon as the sheet has sufficient fiber bonding strength to support itself, shrinkage will accompany further dewatering.

However, the paper web is dimensionally restrained for part of its journey, being supported and transported by fabrics which impose frictional constraints on shrinkage. It is completely supported through the forming and pressing section, but open draws occur thereafter. When subsequent dewatering occurs to these fabrics, the sheet receives an increment of strain, which can be relaxed only when it is in an open draw, where it is less constrained in dimension. If the sheet is sufficiently wet, the strain is generally plastic (no stress is induced), or viscous (stress depends on rate of deformation, rather than on amount). This is the case in the forming and pressing sections, and in the initial drying stages. Strain due to constrained shrinkage when the sheet is drier is generally elastic—it induces a stress or tension. The elastic strain will be maintained if suitable tension is applied, and will relax otherwise.

The sheet is under machine direction (MD) tension in open draws, to support the mass of the web, stabilize its path, provide forces needed to detach it from fabrics and cylinders, and to overcome aerodynamic drag. Local MD tension prevents relaxation of strain in the sheet in the MD. However, if the strain can relax in the CD, this leads to local Poisson or Poisson-like elongation in MD, and results in a lower local MD tension. There is no externally applied CD tension per se, but the sheet is dimensionally restrained in CD at each end of the draw, and the length of the draw is typically much shorter than the sheet width. As a result, there is a CD tension profile induced in the open draw as a result of the CD straining due to dewatering. This CD tension is much less than the MD tension, and falls essentially to zero at the sheet edges, which are less restrained than the sheet center. Thus, although the sheet stretches in the MD both plastically and elastically, more than countering the effect of shrinkage in MD, it shrinks overall in the CD, and the shrinkage is greater at the edges than in the middle of the sheet.

Local MD dimensional change is the sum of local elongations due to CD shrinkage, local plastic strain, and local elastic strain. The amount of local elastic strain largely determines the local web tension (together with the local elastic modulus of the sheet). In an open draw, the total MD dimensional change is the same at all locations across the sheet, and reflects the difference in speed of the upstream and downstream rolls. The MD tension profile will reflect the balance at each point between cumulative MD plastic strain, cumulative MD elongation due to CD shrinkage, current plastic or viscous straining, and cumulative elastic straining at a given speed difference.

In the initial drying, where strain tends to be viscous or plastic rather than elastic, nonuniform MD elongation due to nonuniform CD shrinkage does not affect the tension profile. In later drying, where strain tends to be elastic, nonuniformity in MD elongation causes a tension profile, due to the processes described above. There is a gradual transition between these two regimes, occurring during the initial stages of drying. In the presses and before the first open draw, strain is plastic in both MD and CD, and no dimensional change occurs.

The basic principle of web elongation control according to this invention is to change the evolution of the CD shrinkage profile, so that the CD shrinkage nonuniformity occurs mainly in the initial drying, where plastic strain of the sheet will match MD elongation due to CD shrinkage. Shrinkage in later drying is then more nearly uniform, so that the MD elastic strain (and hence MD tension) are more uniform.

Since the evolution of the shrinkage profile is determined by the evolution of the moisture profile, web elongation control is carried out by nonuniformly dewatering the sheet in the wet end. The intention is that parts of the sheet which tend to shrink more in the CD are dewatered more in the plastic regime. Ideally, this is achieved using a steam box or other suitable CD moisture actuator in the forming section or presses. Since this also causes a nonuniform moisture profile entering the dryers, it may adversely affect the moisture profile at the reel. Preferably, there is also another CD moisture actuator situated close to the reel to correct the moisture profile. If this latter actuator is close to the reel, then its effect on subsequent shrinkage, elongation, and tension is small. However, if it is distant from the reel, its effect on elongation and tension may be significant.

It must be noted that this control strategy will often produce high rewet flows in the same regions as high steam box pressures. This is the opposite of the conventional dual-actuator moisture control, which commonly attempts to avoid that situation in order to economize on energy usage. Said strategy is far from optimal with respect to the resulting elongation and tension profiles. Controlling the elongation and/or tension profiles in addition to the moisture profile leads to a particular range of energy usage, limiting scope for minimization of energy usage. Manipulating the average level of steam box and rewet actuators without compromising their profiling can still be used for energy optimization.

Note also, that it is impossible to achieve flat CD profiles of MD elongation or tension. This is because the CD profile of CD tension falls to zero at the sheet edges in an open draw. As a result, elastic MD strain is lower at the edges, even with zero shrinkage, as the sheet is free to contract elastically in CD to relax elastic MD strain. This is a consequence of standard membrane mechanics. Thus, neither the elongation nor the tension can be uniform, and they will be related through the CD shrinkage.

Moreover, by dewatering nonuniformly in the presses and in the first open draw sections, the overall shrinkage profile Itself may be changed. This is because dewatering in the elastic strain regime is reduced for those parts of the sheet which previously exhibited the most CD shrinkage. Dewatering in a plastic regime with open draws (as in the dryers) is accompanied by CD shrinkage. However, MD elongation is uniform across the sheet, since the straining in the first few open draws is viscous, rather than elastic. Additionally, dewatering in a plastic regime with a fully restrained sheet (as in the presses) causes plastic CD strain instead of CD shrinkage, and no MD elongation.

An advantage of the invention is that the web elongation can be adjusted simply, accurately and in a versatile manner. A further advantage of the invention is that actuators for control of neither the caliper profile nor the grammage profile need be used for control of web elongation. These actuators may thus be freely used to control their designated profile properties, including correcting for any effects caused by the web elongation control of this invention. As a result, the control of elongation does not disrupt control of the caliper or grammage profiles, and no compromise is required.

Furthermore, since the invention uses two CD moisture actuators, it is utilizing a common redundancy which exists in many paper machines. As a result, although the web elongation is controlled using a CD moisture actuator, and this will affect the moisture profile, a second CD moisture actuator is available to compensate for these effects. Thus, both web elongation and moisture profiles can be controlled without compromise.

In this disclosure the tern 'paper' also refers to board and tissue.

BRIEF DESCRIPTION OF THE DRAWINGS

In the following the invention will be described in greater detail in the accompanying drawings, in which FIG. 1 schematically shows a side view of a paper machine.

DETAILED DESCRIPTION OF PREFERRED EMBODIMENTS

Figure 1:
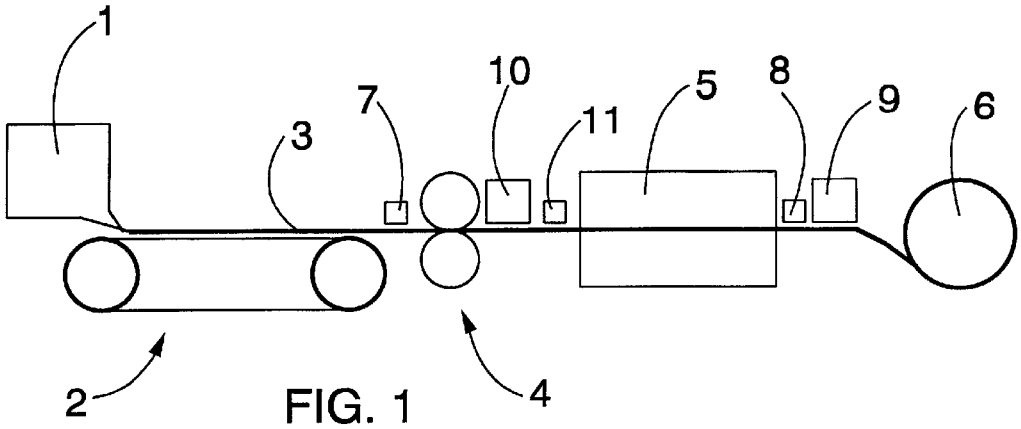

FIG. 1 schematically shows a paper machine. The paper machine comprises a headbox 1, from which pulp is fed into a former 2, where a fiber web 3 is formed of the pulp. The web 3 is conveyed to a press 4 and further to a dryer unit 5. From the dryer unit 5 the web 3 is conveyed to a reel 6. The paper machine may also comprise, for example, size presses or a calender, which are not illustrated in the Figure for the sake of clarity. Furthermore, the function of the paper machine is known per se for those skilled in the art, and will therefore not be further explained in this context.

The web elongation is controlled by use of at least two actuators which affect the CD moisture profile, said actuators being situated at different stages in the web manufacturing process or subsequent processing such as coating, calendering or supercalendering, and printing, especially operations involving rewetting or drying of the web, or operations involving stretching of the paper web in the direction of the movement of the paper web. For example, the first CD moisture actuator could be a sectionally-controlled steam box 7 in the wet presses 4, and the second CD moisture device could be a sectionally-controlled rewet spray device 8 near the reel 6. Note that the CD moisture actuators can be of types other than those depicted, such as sectional infra-red, sectional pocket ventilation, and the like. Similarly, the two CD moisture actuators can be situated at other locations in the paper machine, provided they are separated by at least one processing operation, such as a group of dryer cylinders. A measurement beam 9 comprises a web elongation measurement device, which is used for measuring the elongation profile, and a moisture profile measurement device, which is used for measuring the moisture profile.

Figure 2:
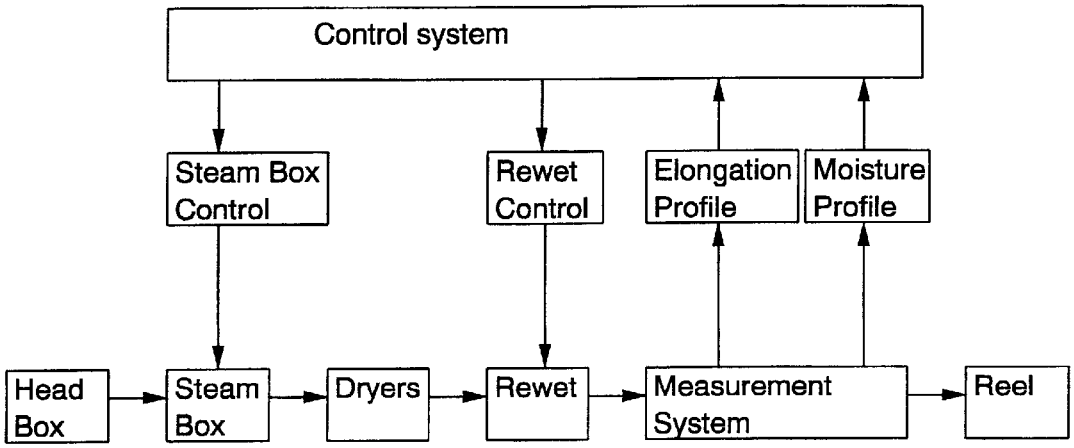
FIG. 2 is a block diagram showing a solution of the invention.

FIG. 2 is a block diagram showing a solution of the invention. In one embodiment of the invention, the first CD moisture actuator is governed to control the web elongation profile measured by the web elongation measurement device, and the second CD moisture actuator is governed to control the moisture profile measurement by the first moisture device. These can be two independent Single Input Single Output (SISO) profile controllers, or they can have provision for cooperation or decoupling.

Figure 3:
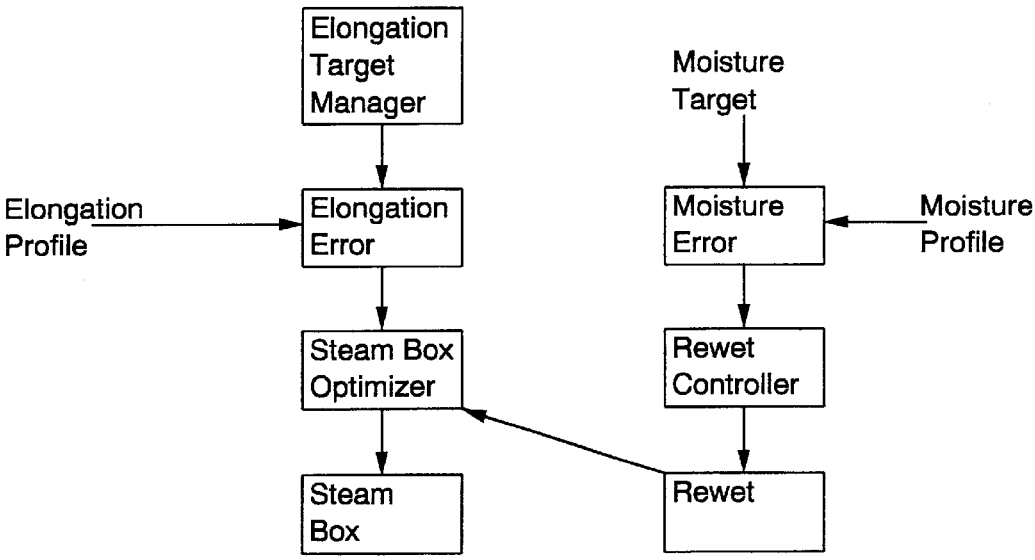
FIG. 3 is a block diagram showing another solution of the invention.

FIG. 3 schematically depicts a variation on this embodiment, which employs a steam box and a rewet actuator, and in which two optional enhancements are shown. First, the control of the steam box employs an optimization, which includes the operating state of the rewet actuator. Thus, control of web elongation using the steam box actuator is not allowed to force the rewet actuator outside set limits. Hence, the moisture profile is given control precedence over the web elongation profile in a simple manner. Second, a web elongation target manager is included for the web elongation profile. This allows the elongation target shape to be adapted to the current elongation level, and/or provides a library of target profiles for web elongation in different operating conditons.

Figure 4:
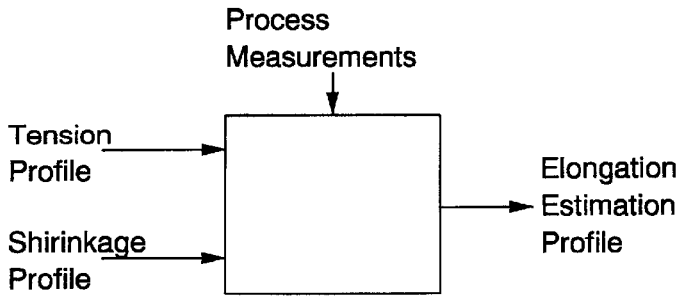
FIG. 4 is a block diagram showing a solution for determining an elongation profile.

FIG. 4 shows a solution, where the elongation profile can be determined on the basis of the tension profile. An elongation estimation profile can be provided by correcting the tension profile with process measurements. The process measurement comprises, for example, total draw, evolution of draw and speed measurement of the paper machine. Since CD shrinkage and MD elongation strongly correlate, the shrinkage profile can also be taken into account when determining the elongation estimation profile. The elongation estimation profile may thus be used, for example, instead of the elongation profile in the solution shown in FIG. 3.

Figure 5:
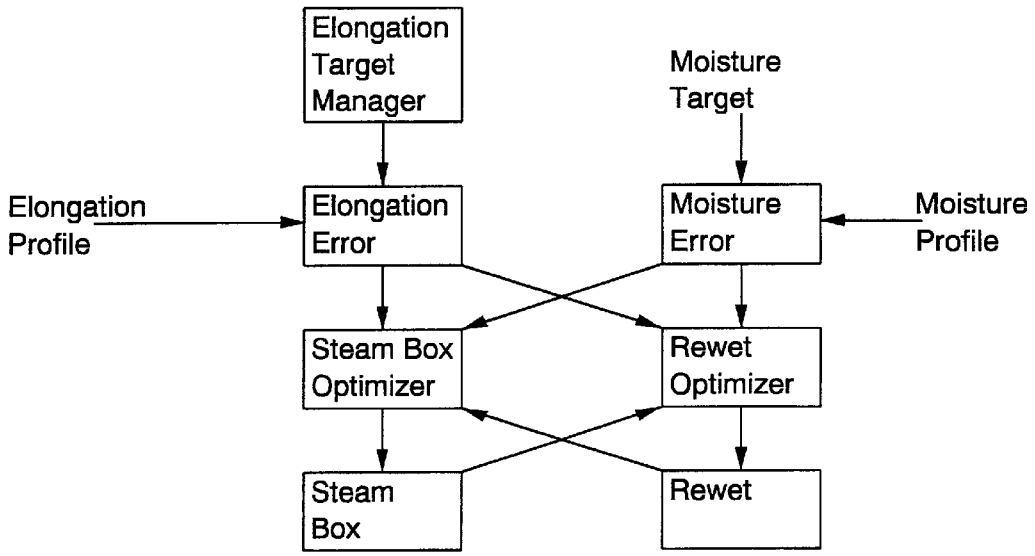
FIG. 5 is a block diagram showing a third solution of the invention.

In another embodiment, the first and second CD moisture actuators are each governed to control both the web elongation and the moisture profiles. Each of the controllers govern a single CD moisture actuator to control a combination of the web elongation and the moisture profiles. For example, the two controllers may employ optimizations, which need not both use the same weighting factors on the two profiles. FIG. 5 schematically depicts a variation on this embodiment, which employs a steam box and a rewet actuator, and in which some optional enhancements are shown. First, bath the steam box control and the rewet control employ optimizations. Second, each optimization includes both the web elongation and the moisture profiles, and includes the operating state of the other actuator. Third, a web elongation target manager is included, as described in an earlier embodiment.

Figure 6:
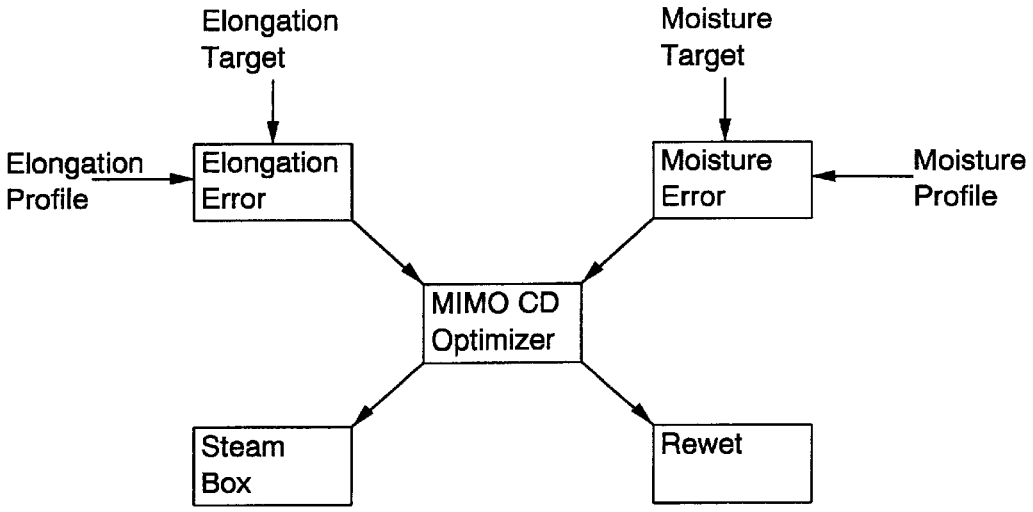
FIG. 6 is a block diagram showing a fourth solution of the invention.

In yet another embodiment, the first and second CD moisture actuators are governed in combination to control both the web elongation and the moisture profiles. FIG. 6 depicts a variation on this embodiment, in which a Multiple Input Multiple Output (MIMO) CD controller employs an optimization to control both the web elongation and the moisture profiles by governing a steam box and a rewet actuator.

The embodiments described above all relate to a paper making machine with two CD moisture actuators and with a single measurement of the web elongation profile and a single measurement of the moisture profile. The depictions of embodiments all relate to the example layout of FIG. 2, in which the CD moisture actuators are a steam box and a rewet. However, these embodiments are illustrative of the Idea of the invention, and do not limit its scope. The disclosed invention anticipates and encompasses other embodiments of the idea of the invention which, for example, additionally (i) utilize further measurements of web elongation and/or moisture profiles at other locations, or (ii) utilize measurements of other profiles at the same or different locations, or (iii) govern further CD moisture actuators, or (iv) govern other CD actuators in addition to CD moisture actuators, or (v) control other properties in addition to web elongation and moisture profiles. The present invention thus anticipates and encompasses combination with control art for profiles of gloss and/or caliper and/or grammage and/or ash and/or coat weight and/or sheet composition and/or fiber orientation and/or opacity and/or color, and with the CD actuators governed to regulate those profiles. The form of combination is a MIMO controller or a set of coordinated or coupled SISO controllers which control at least one other profile in addition to moisture and web elongation, and which govern at least one other CD actuator in addition to the first and second CD moisture actuators, As one example, additional measurement devices, for example a second measurement beam 10 shown in FIG. 1, for moisture and/or web elongation profiles may be situated before the second moisture actuator. The control of web elongation and moisture profiles may additionally employ these measured profiles in its calculations, especially by including them.

As another example, one or more additional CD moisture actuators may be located between the first and second CD moisture actuators. The control of web elongation and moisture profiles can govern these CD moisture actuators in addition to the first and second CD moisture actuators.

Figure 7:
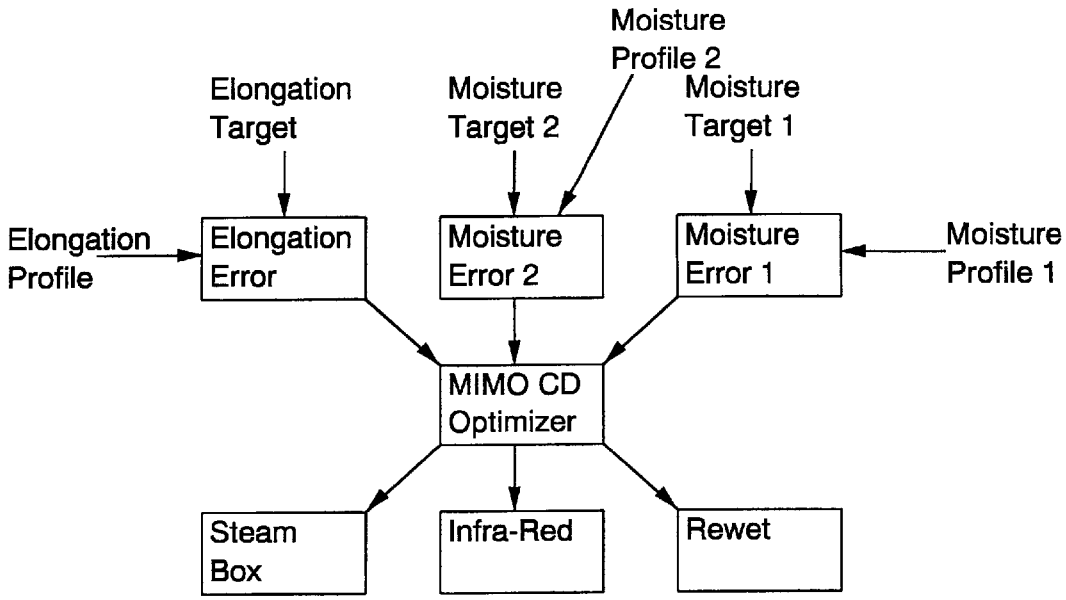
FIG. 7 is a block diagram showing a fifth solution of the invention.

An embodiment exemplifying the use of a second moisture profile measurement and a third CD moisture actuator is depicted in FIG. 7. In the illustrated case, the third CD moisture actuator is of a different type to the other two being for example an infra-red heater 11 shown in FIG. 1, since this is commonly encountered in papermaking, but does not need to be different.

Figure 8:
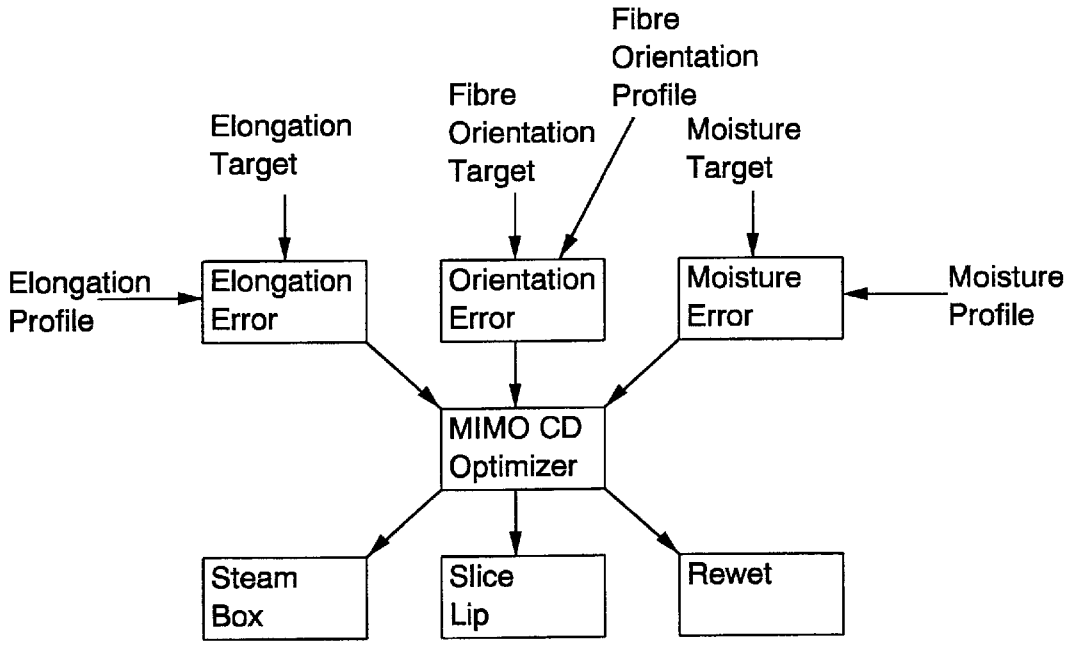
FIG. 8 is a block diagram showing a sixth solution of the invention.

FIG. 8 shows an embodiment exemplifying the use of a different profile measurement and a different CD actuator in combination with the measurements of web elongation and moisture profiles and the two CD moisture actuators. In this case the fiber orientation angle profile is controlled in conjunction with the web elongation and moisture profiles, by governing the slice lip of a headbox in addition to the steam box and rewet actuators. This is particularly valuable in preventing dimensional problems in the paper sheet during manufacture or use. As noted earlier, shrinkage is greatest across the fibers, so that the local fiber orientation distribution determines the local axis of maximum shrinkage. Nonuniform orientation combined with nonuniform shrinkage and tension can lead to planar and a planar deformations of the sheet during drying and during later operations such as printing or converting. The illustrated embodiment employs a MIMO CD optimization, but obviously other configurations can also be used, such as coupled SISO CD controllers.

The drawings and the description thereof are merely intended to illustrate the inventive idea. The details of the invention may vary within the scope of the claims. The blocks in the block diagrams shown in the drawings also depict means producing or providing said function.

What is claimed is:

1. A method of controlling a moving paper web during manufacture or subsequent processing comprising the steps of measuring a web elongation profile and a moisture profile and controlling the web elongation by at least two actuators which affect the CD moisture profile, said actuators being situated at different stages in the web manufacturing process or subsequent processing, and means for measuring the web elongation profile and the moisture profile being situated after the CD moisture actuators.

2. A method as claimed in claim 1, wherein said method is carried out in a paper machine and said at least two CD moisture actuators are separated in a machine direction by at least one processing operation.

3. A method as claimed in claim 2, wherein at least one CD moisture actuator is situated at a wet press and at least one CD moisture actuator is situated at a dry end of the paper machine ahead of a reel.

4. A method as claimed in claim 2, wherein the web elongation profile is governed by at least one CD moisture actuator situated ahead of at least one dryer cylinder of the paper machine and the moisture profile is governed by at least one CD moisture actuator situated after said at least one dryer cylinder of the paper machine.

5. A method as claimed in claim 4, wherein the moisture profile is given control precedence over the web elongation profile.

6. A method as claimed in claim 1, wherein the elongation profile is determined on the basis of a tension profile and a shrinkage profile.

7. A method as claimed in claim 2, wherein at least two CD moisture actuators are governed to control both the web elongation and the moisture profiles.

8. A method as claimed in claim 1, wherein the moisture profile is measured also before the second CD moisture actuator.

9. A method as claimed in claim 1, wherein the elongation and moisture profiles of the web are governed by at least three CD moisture actuators.

10. A method as claimed in claim 1, further comprising measuring a fiber orientation profile and adjusting said fiber orientation by governing a slice lip of a headbox.

11. A method as claimed in claim 1, wherein at least one CD moisture actuator is a steam box.

12. A method as claimed in claim 1, wherein at least one CD moisture actuator is a rewet spray device.

13. An apparatus for controlling a moving paper web during manufacture or subsequent processing comprising means for measuring a web elongation profile and a moisture profile, at least two actuators, which affect the CD moisture profile and means for controlling the web elongation by said CD moisture actuators, said CD moisture actuators being situated at different stages in the web manufacturing process or subsequent processing, and the means for measuring the web elongation profile and the moisture profile being situated after the CD moisture actuators.

14. An apparatus as claimed in claim 13, wherein said apparatus is part of a paper machine and said at least two CD moisture actuators are separated in a machine direction by at least one processing operation.

15. An apparatus as claimed in claim 14, wherein at least one CD moisture actuator is situated at a wet press and at least one CD moisture actuator is situated at a dry end of the paper machine ahead of a reel.

16. An apparatus as claimed in claim 14, further comprising means for controlling the CD moisture actuator situated ahead of at least one dryer cylinder of the paper machine to govern the web elongation profile and for controlling the CD moisture actuator situated after said at least one dryer cylinder of the paper machine to govern the moisture profile.

17. An apparatus as claimed in claim 14, wherein the apparatus comprises means for controlling at least two CD moisture actuators to govern the web elongation profile and the moisture profile.

18. An apparatus as claimed in claim 13, wherein the apparatus comprises second measurement means arranged to measure the moisture profile before the second CD moisture actuator.

19. An apparatus as claimed in claim 13, wherein the apparatus comprises at least three CD moisture actuators arranged to govern the elongation and moisture profiles of the web.

20. An apparatus as claimed in claim 13, wherein the apparatus comprises means for measuring a fiber orientation profile and means for controlling a slice lip of a headbox to govern fiber orientation.

21. An apparatus as claimed in claim 13, wherein at least one CD moisture actuator is a steam box.

22. An apparatus according to claim 13, wherein at least one CD moisture actuator is a rewet spray device.

* * * * *